US007490418B2

(12) United States Patent
Obeydani

(10) Patent No.: US 7,490,418 B2
(45) Date of Patent: Feb. 17, 2009

(54) FOOTWEAR WITH MANUALLY EXTENDABLE SPIKES

(76) Inventor: Michel Obeydani, 235-11215 Jasper Avenue, Edmonton, Alberta (CA) T5K 0L5

( * ) Notice: Subject to any disclaimer, the term of this patent is extended or adjusted under 35 U.S.C. 154(b) by 419 days.

(21) Appl. No.: 11/479,720

(22) Filed: Jun. 30, 2006

(65) Prior Publication Data

US 2008/0016721 A1 Jan. 24, 2008

(51) Int. Cl.
*A43C 15/02* (2006.01)

(52) U.S. Cl. ..... 36/61

(58) Field of Classification Search ..... 36/61, 36/134, 127, 59 R

See application file for complete search history.

(56) References Cited

U.S. PATENT DOCUMENTS

| | | | | |
|---|---|---|---|---|
| 3,343,283 | A | 9/1967 | Henry | |
| 3,717,238 | A | 2/1973 | Fox | |
| 3,747,238 | A | 7/1973 | Jankauskas | |
| 3,793,751 | A | 2/1974 | Gordos | |
| 4,318,231 | A | 3/1982 | Simoneau | |
| 4,375,729 | A | 3/1983 | Buchanen, III | |
| 4,821,434 | A | 4/1989 | Chein | |
| 4,873,774 | A | 10/1989 | Lafever | |
| 5,269,080 | A | 12/1993 | Davis | |
| 5,289,647 | A | 3/1994 | Mercer | |
| 5,497,565 | A | 3/1996 | Balgin | |
| 5,557,865 | A * | 9/1996 | Sjosvard | 36/61 |
| 5,634,283 | A | 6/1997 | Kastner | |
| 5,737,855 | A | 4/1998 | Jordan et al. | |
| 5,740,619 | A | 4/1998 | Broder | |
| 5,870,838 | A | 2/1999 | Khayat | |
| 6,058,627 | A | 5/2000 | Violette et al. | |
| 6,125,556 | A * | 10/2000 | Peckler et al. | 36/127 |
| 6,256,907 | B1 * | 7/2001 | Jordan et al. | 36/61 |
| 6,389,714 | B1 | 5/2002 | Mack | |
| 6,449,880 | B1 | 9/2002 | Calabrese et al. | |

* cited by examiner

*Primary Examiner*—Ted Kavanaugh
(74) *Attorney, Agent, or Firm*—Gene Scott; Patent Law & Venture Group

(57) ABSTRACT

A shoe provides a gear assembly mounted within a heel portion, the gear assembly providing an actuator gear communicating with a plurality of drive gears. Threaded couplings are fixedly engaged with a sole portion and a plurality of spikes are threadedly engaged with the couplings. Drive shafts, transfer rotation from the drive gears to the spikes. An actuator gear is manually rotated for extending, and retracting the spikes.

6 Claims, 4 Drawing Sheets

FOOTWEAR WITH MANUALLY EXTENDABLE SPIKES

CROSS-REFERENCE TO RELATED APPLICATIONS

Not Applicable.

STATEMENT REGARDING FEDERALLY SPONSERED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

REFERENCE TO A "MICROFICHE APPENDIX"

Not Applicable.

BACKGROUND OF THE INVENTION

1. Field of the Present Disclosure

This disclosure relates generally to footwear with spiked soles and more particularly to such footwear wherein the spikes are extendable and retractable as desired during wearing.

2. Description of Related Art Including Information Disclosed Under 37 CFR 1.97 and 1.98

Calabrese et al., U.S. Pat. No. 6,449,880, discloses an antislip apparatus provided for footwear to be fit on a region of a sole and/or a heel of a shoe defining an engagement surface in contact with the ground surface. The antislip apparatus includes a ground gripping structure for engaging the ground surface including a support and crampon-like prongs disposed on the support extending perpendicularly from the support. A cam arrangement interacts with the support for moving the prongs to one of a grip position with the prongs extending beyond the level of the engagement surface, or to a rest position with the prongs disposed inwardly of the engagement surface. The cam arrangement includes a plate disposed substantially parallel to the support and cams acting on one of the support and the plate to vary a distance between the support and the plate to move the prongs. An operating arrangement or actuator is provided for operating the cam arrangement. The actuator includes a cylindrical rotor formed integral with the plate. The rotor is disposed perpendicularly to the support and has at a lower end thereof, accessible from a side of the engagement surface, a seat defined by a groove or cut. A holding box element contains the support, the cam arrangement and the actuator. The holding box element is provided one of below or on the engagement surface. The holding box element includes an opening allowing access to the actuator and has one or more slots which the prongs extend through in the grip position. Mack, U.S. Pat. No. 6,389,714, discloses a shoe having retractable spikes; including a shoe portion comprised of a sole portion having a heel portion and a toe portion. The heel portion and the toe portion each have a plurality of apertures therethrough in a spaced relationship. A pair of plates are disposed within the hollow interior of the sole portion. The pair of plates each have a plurality of spikes extending downwardly therefrom in a spaced relationship. The plurality of spikes are aligned with the plurality of apertures of the heel portion and the toe portion of the sole portion. The pair of plates each have a pair of springs extending downwardly therefrom which bias the plate upward. A deployment mechanism provides an extended orientation whereby the pair of plates extend downwardly against the biasing of the springs with the spikes extending through the apertures. Violette et al., U.S. Pat. No. 6,058,627, discloses an article of footwear which includes a sole having a cavity formed therein and a plurality of holes extending from the cavity to the bottom surface of the sole. A spike is disposed in each one of the holes, and each spike is translatable between an extended position wherein a first end of the spike protrudes from the bottom surface of the sole and a retracted position wherein the first end does not protrude from the bottom surface of the sole. A slide member is slidably disposed in the cavity and has a plurality of recesses formed in a first surface thereof which is oriented towards the spikes. The slide member is translatable in a lengthwise direction between a first position wherein the recesses are aligned with the spikes so that the spikes assume their retracted position and a second position wherein the recesses are not aligned with the spikes so that the spikes assume their extended position. Khayat U.S. Pat. No. 5,870,838, discloses a retractable spike system for providing traction when desired under the entire surface of a footwear sole and heel. Two or more retractable spike assemblies are inserted into cavities in the sole and heel of the footwear. The spikes on each assembly can be engaged by a cam or wedge pressing on a carrier plate. All the assemblies are connected together by a rigid coil attached to the cams or a shaft to which the wedges are fixed, in such a manner that a single mechanism can simultaneously retract or extend all the spikes on all assemblies. Broder, U.S. Pat. No. 5,740,619, discloses a retractable stud for a footgear sole carried by a movable backing plate having a underlying air inflatable and air deflatable bladder with means for air inflation and air deflation which in turn has an underlying footgear outer sole having a bottom outer surface defining an opening for passage of the retractable stud, the bladder in an air inflated configuration moving the backing plate inboard thus holding the stud against the weight of the wearer of the sole in a retracted position entirely within the bottom outer surface of the outer sole, the bladder in an air exhausted deflated configuration allowing the weight of the wearer of the sole to move the backing plate outboard thus holding the stud in a protruding position beyond the bottom outer surface of the outer sole. Jordan et al., U.S. Pat. No. 5,737,855, discloses a spiked athletic shoe including a shoe upper, and an outsole housing connected to the shoe upper. The outsole housing includes a bottom wall with a plurality of spike-receiving openings. Spaced-apart rear and front spike plates are located within the outsole housing, and reside respectively in a rear heel portion of the shoe and a front portion of the shoe generally in an area of the ball and toes of the foot. The rear and front spike plates include a plurality of spikes attached thereto for movement between a spike-extended position whereby the plurality of spikes extend outwardly from the bottom wall of the outsole housing, and a spike-retracted position whereby the plurality of spikes are retracted within the outsole housing. A slide plate located within the outsole housing operatively engages the rear and front spike plates, and is actuated by a manually actuated lever to move the rear and front spike plates and attached spikes between the spike-retracted position and the spike-extended position. Kastner, U.S. Pat. No. 5,634,283, discloses a resilient, all-surface sole for footwear in which metal studs are mounted in the sole and extend beyond the bottom surface of the sole to such an extent that when footwear embodying the sole is worn, the metal stud is depressed within the sole until the tips of the studs are substantially at the plane of the bottom surface of the sole. Balgin, U.S. Pat. No. 5,497,565, discloses a projectable-retractable spike assembly for use in combination with footwear. The heel and sole of a piece of footwear encase a rotatable shaft and lock subassembly, with a motion translation (conversion) device which is used to drive a network of shafts, levers and rotatable roller bars. Several spikes depend from the roller bars and thus, are motivated to alternately roll out and downward from or upward and into the heel and sole of the footwear. The assembly may be either fabricated for strap-on wear or encased within heel-sole portions of a shoe or boot. Mercer, U.S. Pat. No. 5,289,647, discloses a golf shoe with a sole and a heel attached to an upper. A spike is housed within a housing inserted into the sole or the heel. The housing includes a hollow cylinder threaded into the sole or heel. The cylinder houses a helical spring that biases a spike to the extended position. When the shoe is used on a hard surface, the surface forces the spike upward against the spring to a retracted position. Davis, U.S. Pat. No. 5,269,080, discloses an athletic shoe with a sole that is slightly, if at all, thicker than soles that are common to athletic shoes. A plurality of spikes or cleats are caused to depend from the bottom of the sole by an actuation mechanism that has a rotatable knob projecting from the back of the athletic shoe. The structure of the sole provides for openings to the undersurface to allow spikes to pivot outwardly beyond the undersurface of the sole. The actuating device has an actuator slide that translates a transverse movement to a pivotal movement of the spikes. Lafever, U.S. Pat. No. 4,873,774, discloses a shoe sole provided with one or more chambers therein. A piston-like cleat plate is fitted for vertical movement in each chamber. Cleats are fitted to the cleat plates, and openings are provided in the chamber bottom for permitting the cleats to pass therethrough when extended. The cleat plates are spring-biased to a retracted position. A source of fluid pressure such as a squeeze bulb type air pump is connected for supplying fluid pressure to the chambers to cause the cleat plates to move downwardly to extend the cleats from the sole bottom, to provide gripping traction. An inflatable member can be provided above the cleat plate in each chamber. A pair of soles may be connected via supply lines to a remote pump positionable at a convenient location on the wearer's person. Chein, U.S. Pat. No. 4,821,434, discloses a shoe with spikes which can be extended and retracted by T-shaped rail members which are actuated by respectively impacting the front or the rear of the shoe sole against a solid target such as a wall or road surface. Buchanen, III, U.S. Pat. No. 4,375,729, discloses anti-skid spikes for use on shoes or boots, to provide firm footing on ice or snow. The spikes are readily extendable and retractable without the use of keys or tools, e.g., when entering a car or a house where floors and rugs might otherwise be damaged thereby. A mechanism for selectively extending and retracting the spikes is sealed within the sole and heel of the footwear to provide improved esthetics and to prevent interference with the mechanism, as by moisture and ice, when temperatures vary from hot to cold. Simoneau, U.S. Pat. No. 4,318,231, discloses within a jogging shoe having a rubber sole, and a mid-sole detachably secured in the soles, a stud for enabling the runner to run safely in winter under icy conditions. The stud projecting from the out-sole of the shoe. Gordos, U.S. Pat. No. 3,793,751, discloses a retractable spike, particularly for a golf shoe and the like, whereby the spikes can be either of protruded or retracted from the bottom sole of the shoe, to protect the floor of a clubhouse or the turf on the green. This movement of the spikes can be accomplished from the outside of the shoe by a mere rotation of a protruding knob. Jankauskas, U.S. Pat. No. 3,747,238, discloses an apparatus for providing gripping studs in footwear, particularly where such apparatus is utilized on very hard surfaces such as sun baked ground, packed snow, or ice. The studs are completely contained within the bottom structure of the footwear to reduce the probability of damage or injury being caused thereby when the footwear is not in use. An elastic material is utilized for the bottom structure, which therefore compresses to concentrate the loads on the studs when the footwear is in use. Edges are disposed as the penetrating surface on each stud to facilitate penetration of the walking surface and to maximize the gripping surface developed for very small penetrations. Various stud configurations and arrangements are provided to prevent the gripping surface in accordance with the needs of differing applications. To minimize the weight of the footwear and maximize its flexure, arcuately shaped bands are utilized for retaining the studs within the footwear. Fox, U.S. Pat. No. 3,717,238, discloses a retractable anti-slip device for a ski shoe consisting of a tubular metal casing transversely embedded in the sole of heel of the shoe, the casing having a longitudinal rotatable camming member therein mounted over a longitudinal plate element provided with depending spurs accessible through openings in the bottom wall portion of the casing and being therefore extensible downwardly from the bottom plane of the sole or heel. The plate member is biased upwardly by springs to retract the spurs. The rotatable camming member has a radial handle element at its end, which is accessible by the user for manually operating the camming member. Henry, U.S. Pat. No. 3,343,283, discloses a retractable anti-slip device for shoe heels, installed within a hollow shoe heel containing spike holes in the bottom thereof and having ground-gripping prongs or spikes bifurcated level and positively projected and retracted through those holes by a crank mounted on an operating rod which is rotated by means of a key, in order to swing the crank into and out of alternate or successive engagement with the arms of the bifurcated lever so as to protect the wearer against slipping while walking on icy surfaces. Halstead, U.S. Pat. No. 1,662,111, discloses an anti-slipping device comprising a casing adapted to be embedded in a shoe heel, a rotatable shaft extending through the casing, a series of internally threaded housings adapted to be embedded in a shoe heel, an attaching flange formed on the upper portion of each housing for attachment to the bottom of the casing, an externally threaded calk arranged within each internally threaded housing, the lower end of each calk being pointed for engagement with the ground, a rectangular shank formed on the upper end of each calk and extending into the casing, a plurality of sleeves arranged in the casing directly above the respective housing, the bore of each sleeve being rectangular for receiving the rectangular shank of the respective calk, the shank being slidable in the sleeve, a worm wheel formed on the upper portion of each sleeve, said shaft being formed with a series of worms for cooperation with the respective worm wheels whereby the calks may be raised or lowered when the shaft is actuated.

Our prior art search described above teaches anti-slip attachments for footwear and footwear with retractable spikes including spikes manually deployed by cables. However, the prior art fails to teach the presently described simplified apparatus providing heretofore unknown advantages as described in the following summary.

BRIEF SUMMARY OF THE INVENTION

This disclosure teaches certain benefits in construction and use which give rise to the objectives described below.

A shoe provides a gear assembly mounted within a heel portion, the gear assembly providing an actuator gear communicating with a plurality of drive gears. Threaded couplings are fixedly engaged with a sole portion and a plurality of spikes are threadedly engaged with the couplings. Drive shafts, transfer rotation from the drive gears to the spikes. An actuator gear is manually rotated for extending, and retracting the spikes.

A primary objective inherent in the above described apparatus and method of use is to provide advantages not taught by the prior art.

Another objective is to provide a shoe with manually retractable spikes.

A further objective is to enable such a shoe with a simplified mechanism to quickly extend and retract the spikes.

A still further objective is to provide such a shoe that is not bulky and does not have an unusually thick heel or sole.

Other features and advantages of the described apparatus and method of use will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

The accompanying drawings illustrate at least one of the best mode embodiments of the present apparatus and method of it use. In such drawings.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
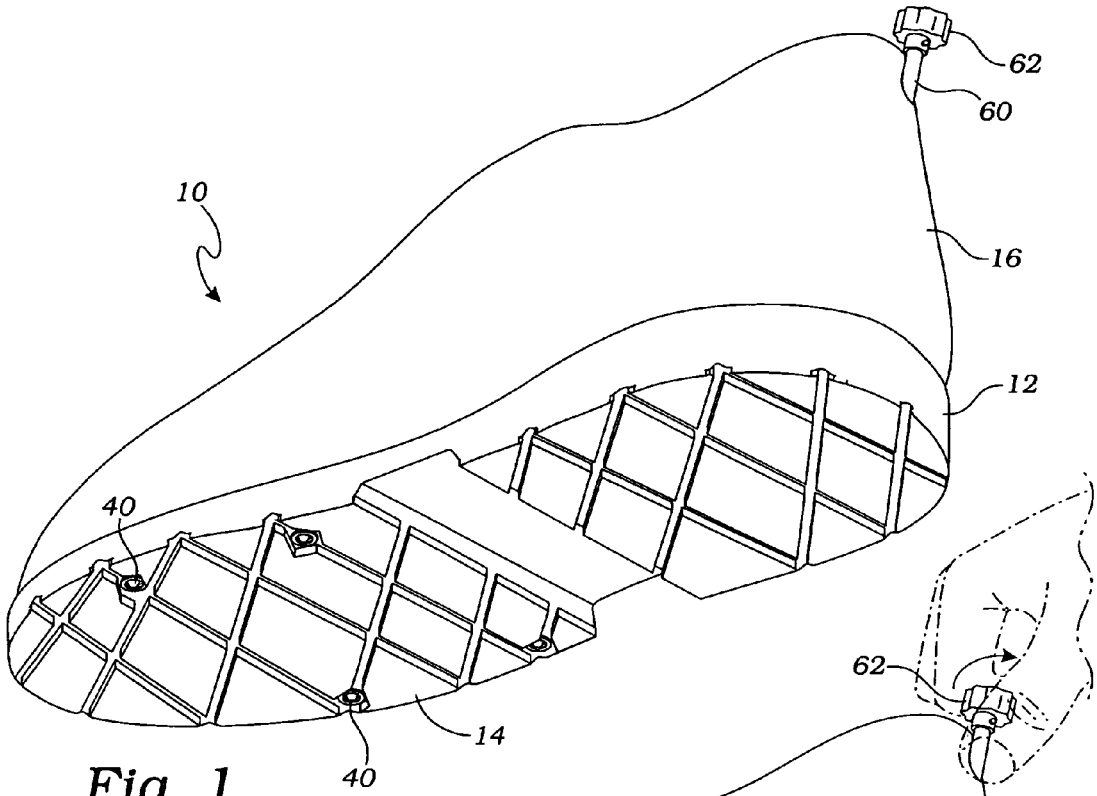
FIG. 1 is a perspective view of the presently described apparatus as viewed from below with spikes retracted.
Figure 2:
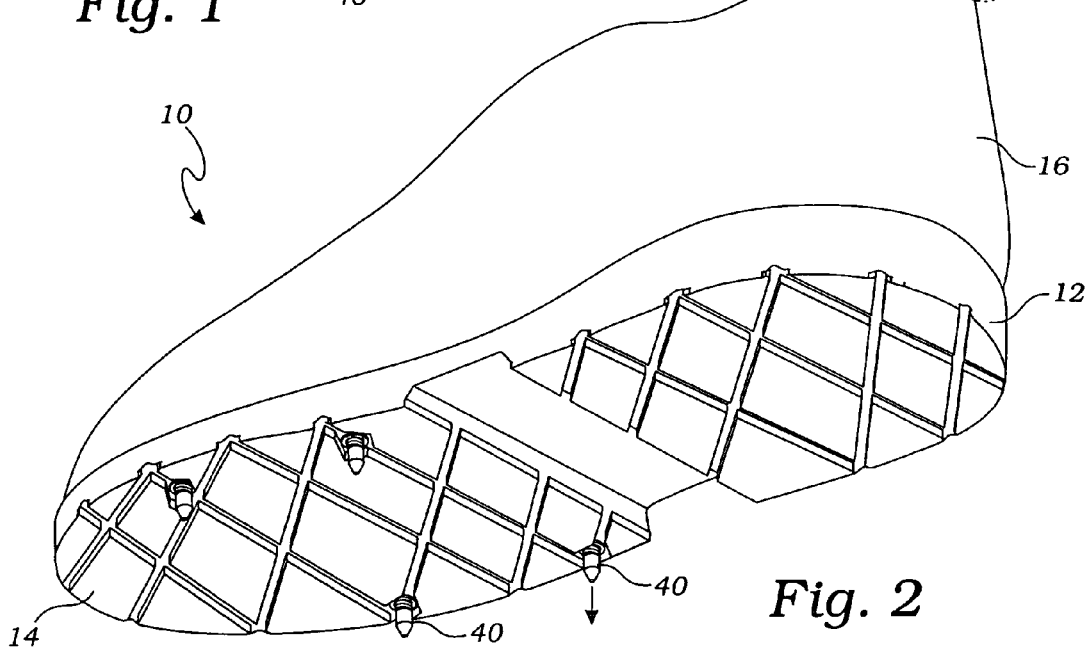
FIG. 2 is a perspective view of the presently described apparatus as viewed from below with spikes extended and illustrating the manual adjustment.
Figure 3:
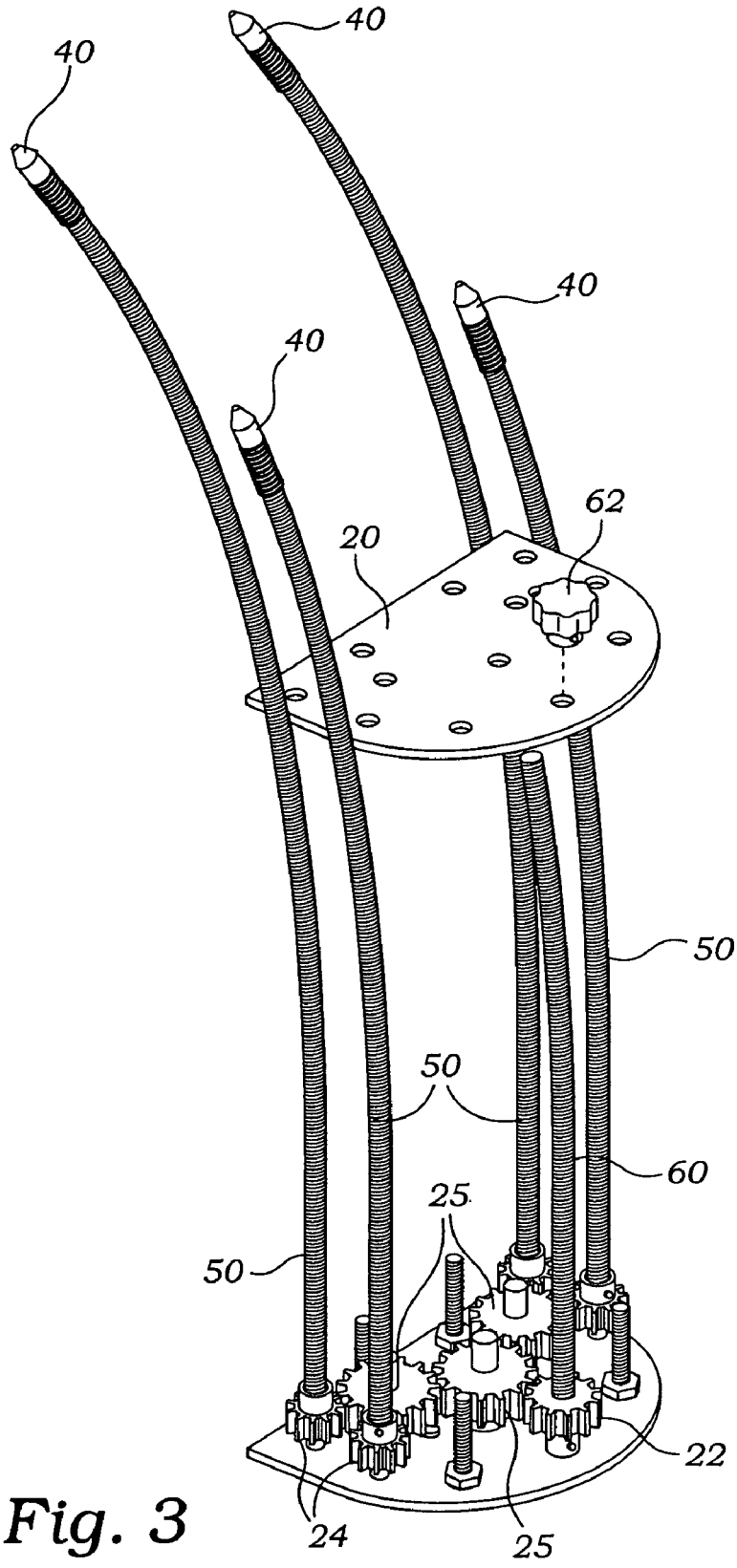
FIG. 3 is a perspective view of a gear assembly and drive shafts thereof shown partially disassembled.

Described now in detail a footwear apparatus with retractable spikes. The footwear may be a shoe, a boot, a golf shoe or any other footwear 10 that provides a heel portion 12, a sole portion 14 and a side wall portion 16, as shown in FIG. 1 and FIG. 2. The word "shoe 10" will be used throughout this specification to refer to footwear 10, but it should be noted that the meaning of shoe should be taken in the broadest sense of the idea of footwear.

Figure 4:
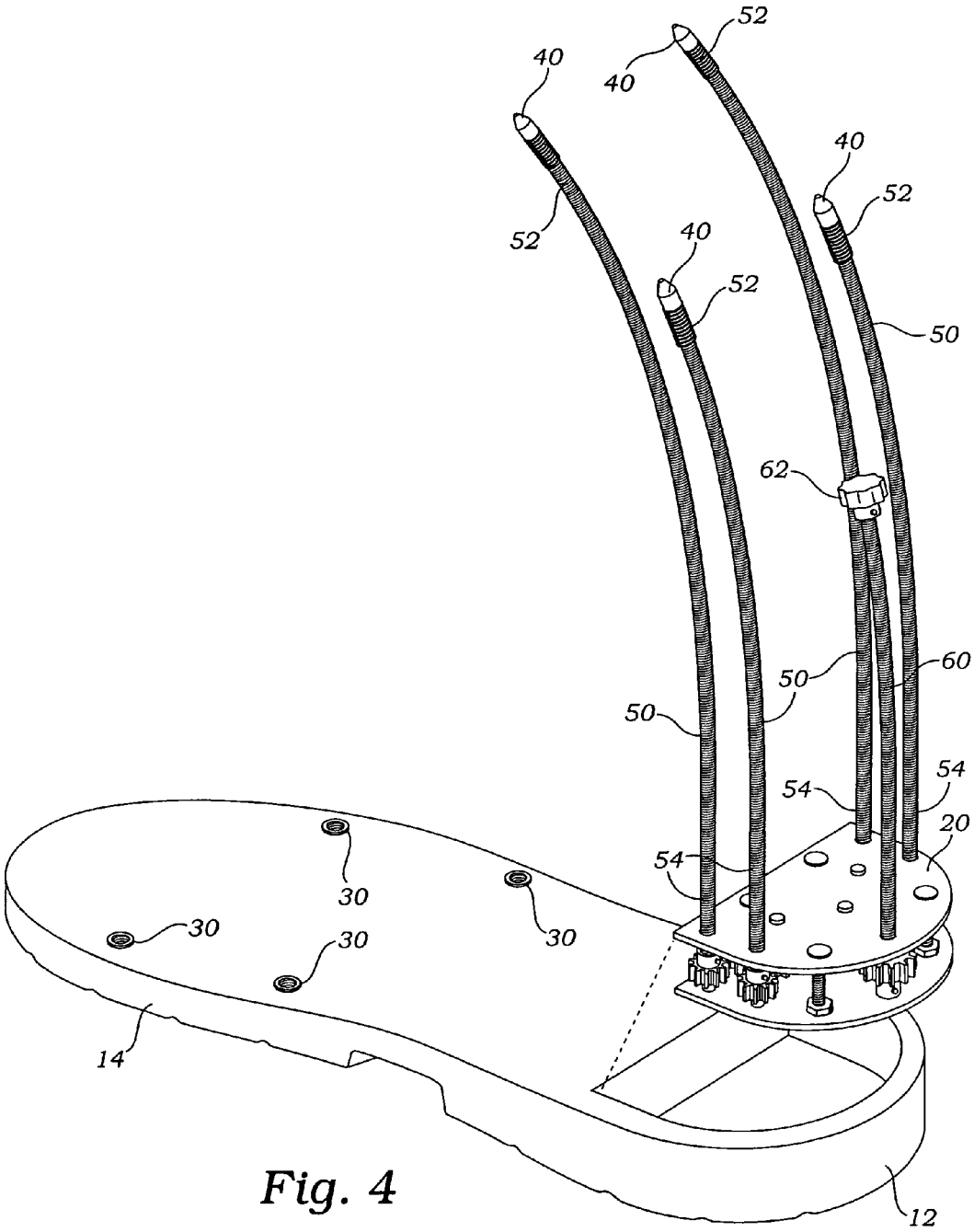
FIG. 4 is a perspective view thereof shown assembled and ready for insertion into a heel of a shoe.
Figure 5:
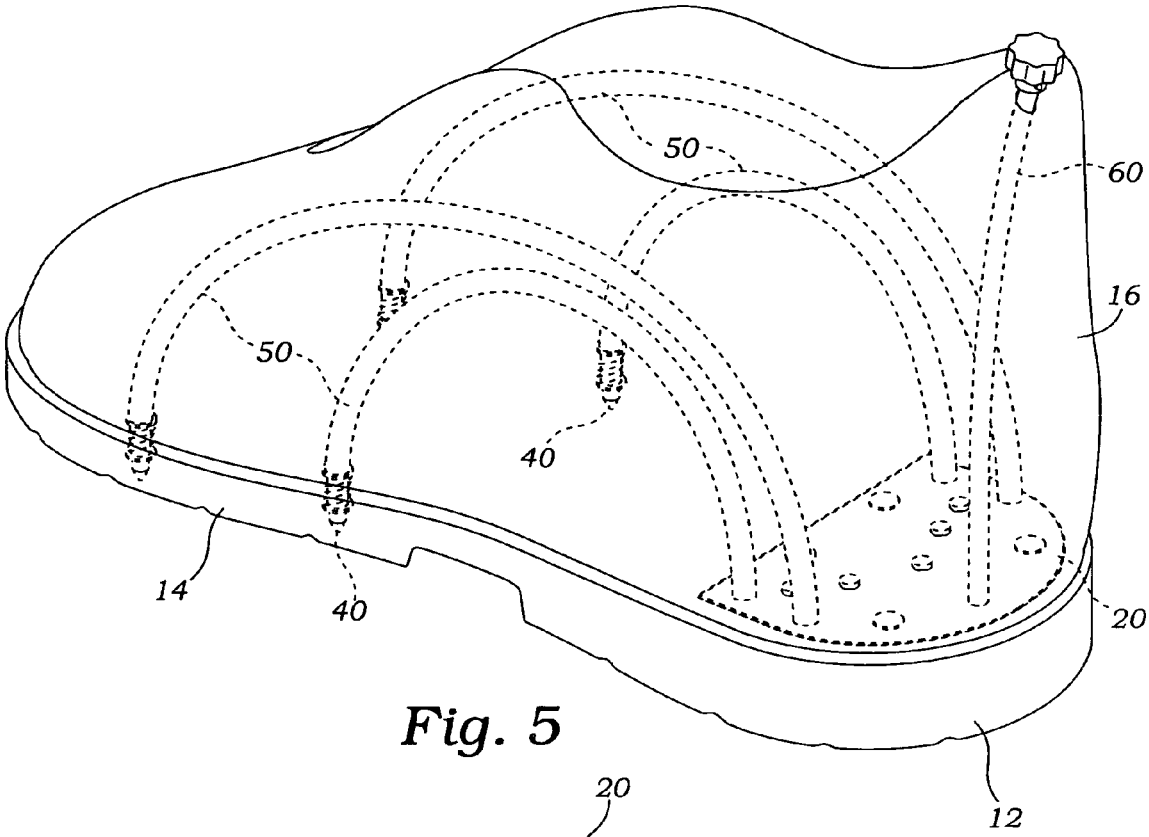
FIG. 5 is a perspective view thereof shown as assembled within a shoe.

Generally, by "sidewall portion 16" of the shoe 10 is meant the upper portion including that portion of a shoe that covers the sides and top of a foot. A gear assembly 20 (FIG. 4) is mounted within the heel portion 12 of shoe 10. The gear assembly 20 provides an actuator gear 22 communicating with a plurality of drive gears 24 for transmitting rotational forces. A plurality of threaded couplings 30 are fixedly engaged with the sole portion 14 as best illustrated in FIG. 4, and a plurality of spikes 40 are each threadedly engaged with one of the threaded couplings 30 as shown in FIG. 5, so that each of the spikes 40 is free to rotate within a coupling 30 whereby the spikes 40 may advance or retreat axially with respect to the couplings 30.

A plurality of flexible drive shafts 50, preferably made of steel springs, are each fixed axially at a distal end 52 with one of the spikes 40, and axially at a proximal end 54 with one of the drive gears 24. A flexible actuator shaft 60 is engaged axially with the actuator gear 22. The actuator shaft 60 terminates distally with an actuator knob 62 which is used for manual rotation of the shaft 60, whereby such rotation transfers rotational forces to the spikes 40 through gear assembly 20 and drive shafts 50 for extending, and alternately retracting the spikes 40 within the threaded couplings 30.

Preferably, the threaded couplings 30 are positioned within the sole portion 14 for enabling the spikes 40 to extend below the sole portion 14 as shown in FIG. 2, when rotated in a first rotational sense, i.e., clockwise, and for withdrawing when rotated in the opposing sense as shown in FIG. 1. The actuator shaft 60 and the drive shafts 50 are conducted within the side wall portion 16 of the shoe 10, as shown in FIG. 5, so that they do not interfere with a foot within the shoe 10, and do not impede walking and other activities when wearing the shoe 10.

Figure 6:
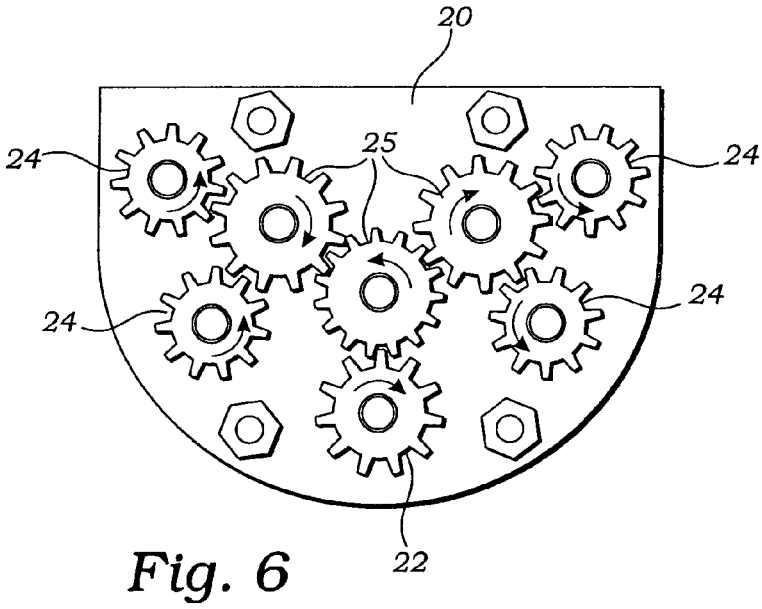
FIG. 6 is a mechanical schematic diagram of the gear assembly.

Preferably, as shown in FIG. 6, the actuator gear 22 is located as far back in the heel portion 12 as possible for convenient interconnection with the actuator knob 62, preferably located high on the extreme rear of the side wall portion 16. Likewise, the drive gears 24 are located as close to the left and right sides of the heel portion 12 as possible for effective interconnection with the drive shafts 50 which are conducted forward within the side wall portion 16. Therefore, in order to transfer rotational force between the actuator gear 22 and the drive gears 24, intermediary gears 25 are used as shown between the actuator gear 22 and the drive gears 24.

In the preferred embodiment, as shown in FIG. 5, the drive shafts 50 each are curved by approximately 180 angular degrees as they travel from the gear assembly 20 to their respective spikes 40. Rotational force is able to be directed over this range of direction change by using tightly wound coil springs for the drive shafts 50. Therefore rotation of the drive shafts 50 at the spikes 40 is clockwise, as viewed from above, while rotation of the drive shafts 50 at the drive gears 24 is counter-clockwise, again, as viewed from above. It is desired to use threaded couplings 30 and threaded spikes 40 that have a right-hand thread so that extension of the spikes occurs when the spikes 40 are rotated clockwise within the couplings 30 and retraction occurs when the spikes 40 are rotated in a counterclockwise sense.

Also, it is desired to have the spikes 40 extend when the actuator shaft 60 and knob 62 are rotated clockwise, as viewed from above. To accomplish this, the actuator gear 22 is interconnected with the drive gears 24 through two intermediary gears 25 as shown in FIG. 6. Please notice that when the actuator gear 22 is rotated clockwise (CW), its adjacent intermediary gear 25rotates counterclockwise (CCW), and the two intermediary gears 25 engaged with the adjacent intermediary gear 25 rotate CW, and finally the four drive gears 24 rotate CCW as shown. Therefore, the proximal ends 54 of drive shafts 50 also rotate CCW and because these shafts 50 turn by 180 angular degrees, the distal ends 52 of the drive shafts 50 and spikes 40 rotate CW as desired, with all of the above rotations as seen from above. Preferably, the actuator knob 62 is positioned rearwardly on the shoe and above the heel portion as shown in FIG. 2 for convenience of the wearer to reach down and easily rotate the actuator knob 62.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A footwear apparatus with retractable spikes comprising: a shoe having a heel portion, a sole portion and a side wall portion; a gear assembly mounted within the heel portion of the shoe, the gear assembly providing an actuator gear communicating with a plurality of drive gears; a plurality of threaded couplings fixedly engaged with the sole portion; a plurality of spikes, each one of the spikes threadedly engaged with one of the threaded couplings; a plurality of flexible drive shafts, each one of the drive shafts fixed axially at a distal end thereof with one of the spikes, and axially at a proximal end thereof with one of the drive gears; a flexible actuator shaft engaged axially with the actuator gear, the actuator shaft terminating with an actuator knob for manual rotation thereof, whereby such rotation of the actuator knob and actuator shaft transfers rotation to the spikes for extending, and for retracting within the threaded couplings.

2. The apparatus of claim 1 wherein the threaded couplings are positioned for enabling the spikes to extend below the sole portion of the shoe when rotated in a first rotational sense and for withdrawing so as to not extend below the sole portion of the shoe when rotated in an opposing sense.

3. The apparatus of claim 1 wherein the actuator shaft and the drive shafts are conducted within the side wall portion of the shoe.

4. The apparatus of claim 1 further comprising at least one intermediary gear engaged between the actuator gear and the drive gears.

5. The apparatus of claim 4 wherein the drive shafts each are curved by approximately 180 angular degrees.

6. The apparatus of claim 1 wherein the actuator knob is positioned rearwardly on the shoe and above the heel portion.

* * * * *